United States Patent [19]

Lieber

[11] Patent Number: 4,759,250

[45] Date of Patent: Jul. 26, 1988

[54] MUSICAL INSTRUMENT NECK

[76] Inventor: Thomas G. Lieber, 242 E. Argyle St., Valley Stream, N.Y. 11580

[21] Appl. No.: 51,317

[22] Filed: May 19, 1987

[51] Int. Cl.[4] ..... G10D 3/18

[52] U.S. Cl. ..... 84/293; D17/14; 84/328

[58] Field of Search ..... D17/14–21; 84/267–269, 291, 293, 314 R, 318, 328

[56] References Cited

U.S. PATENT DOCUMENTS 743,054 11/1903 Bergren ..... 84/318
1,692,207 11/1928 Hall ..... 84/314 R
3,392,618 7/1968 Pelensky ..... 84/267
4,213,370 7/1980 Jones ..... 84/291

FOREIGN PATENT DOCUMENTS 575158 4/1933 Fed. Rep. of Germany ..... 84/293
2043309 3/1972 Fed. Rep. of Germany ..... 84/293

*Primary Examiner*—Lawrence R. Franklin

[57] ABSTRACT

Neck constructed of wood or synthetic material with underside having a spaced apart pair of grooves running parallel in the direction of the strings and defining a central ridge portion of the undersurface which serves as the contact surface for the player's hand during the playing of the instrument.

3 Claims, 1 Drawing Sheet

MUSICAL INSTRUMENT NECK

BACKGROUND OF THE INVENTION

This invention relates generally to necks for stringed musical instruments, and, more particularly, to the undersurface of the neck and a novel ridged construction for improving the playability of the instrument.

Typical musical instrument necks, such as those of guitars, have U-shaped undersurfaces, the necks typically being formed of wood, plastic or fiber-reinforced plastic. The undersurface of such guitars is of a continuous, uninterrupted form, from one side of the fingerboard down, under the neck and up to the fingerboard again on the other side. This continuous undersurface runs the entire length of the neck, and is used by the player for bracing the hand while pressing down on the strings from above. During playing of the guitar, for example, the thumb-hand portion of the fretting hand of the player maintains contact with the undersurface as the player's fingers move up and down the fingerboard, the thumb or palm sliding along the undersurface as various fingerings are employed.

An example of such typical U-shaped neck is shown in U.S. Pat. No. 4,313,362; (Lieber), disclosing a reinforced plastic guitar. A modification of the U-shape structure is disclosed in U.S. Pat. No. 3,091,150 (Sceusa). Although U-shaped necks have proven to be effective for many years for most musical requirements, there remains a problem as to the playing of faster music, especially in the area of popular or rock guitar music. Such music usually requires the guitarist's fretting hand to move very quickly up and down the guitar neck. As a result of continued faster playing, physical drag builds up between the player's fretting hand and the undersurface of the neck, inhibiting the guitarist in the playing of faster pieces and leading to fatigue of the fretting hand.

The ridged construction of the neck of this invention provides an instrument having significantly improved playability due to the lowering of physical drag between the player's fretting hand and the under-surface of the neck, which allows the player to play faster musical passages more accurately, and with less fatigue.

SUMMARY OF THE INVENTION

In accordance with this invention there is provided a stringed musical instrument neck having a pair of parallel spaced apart grooves running along the undersurface of the neck and defining a ridge portion thereon against which the player's fretting hand maintains intermittent contact during the playing of the instrument. The ridged construction is especially valuable for acoustic or electric guitars, where fast music is often the norm, although such novel construction would be of advantage for other stringed instruments, such as the violin, viola, et al.

It is a primary objective of this invention to provide a stringed musical instrument neck adapted for allowing the instrument to be played as fast and accurately as possible with a minimum of fatigue.

It is another objective of this invention to provide an improved neck for fiber-reinforced plastic electric guitars, particularly those types used in the playing of popular or rock music.

It is a further objective of this invention to provide a guitar neck which maintains its normal thickness along its undersurface and yet diminishes drag between the player's hand and the undersurface of the neck to allow more effortless playing of the instrument.

DESCRIPTION OF THE PREFERRED EMBODIMENTS

Figure 1:
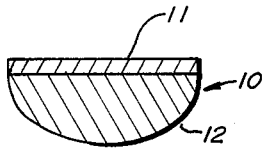
FIG. 1 is a cross-sectional view of a conventional guitar neck.

Referring more specifically to the drawings, FIG. 1 shows a conventional U-shaped guitar neck 10 in cross-section, with fingerboard 11 attached to the upper surface thereof. The undersurface 12 of such neck is continuously smooth from one side of the neck to the other, such uniformity being present along the undersurface from the peghead to the body of the instrument.

Figure 2:
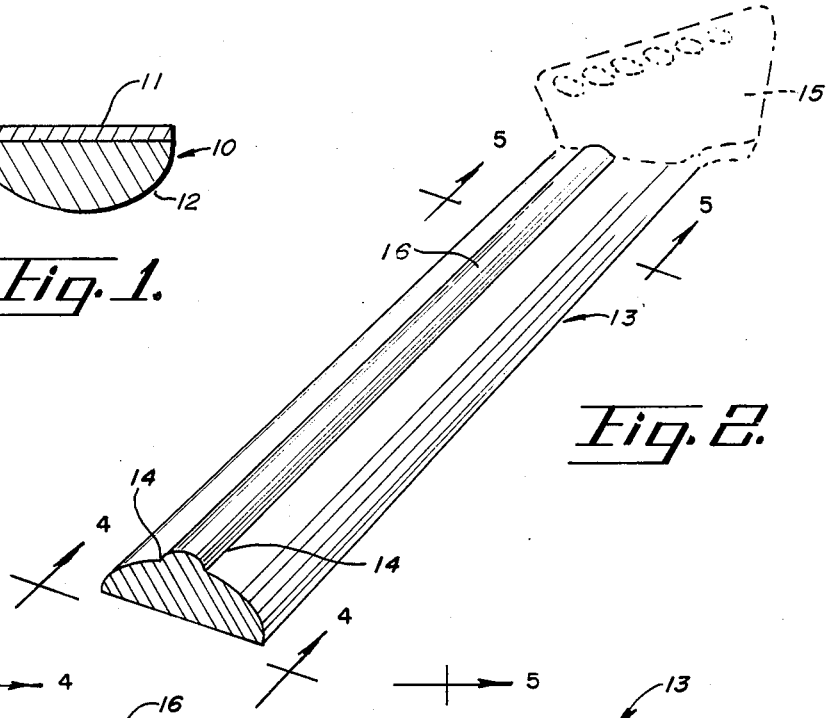
FIG. 2 is a fragmentary perspective view of the undersurface of a guitar neck utilizing the structure of this invention.
Figure 3:
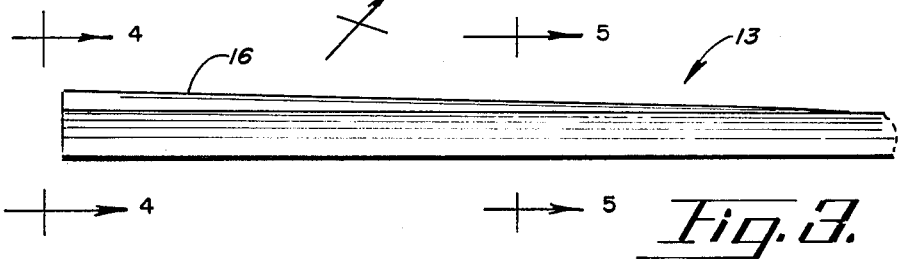
FIG. 3 is a side elevational view of the guitar neck.
Figure 4:
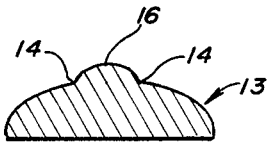
FIG. 4 is a cross-sectional view, as in FIG. 1, taken at line 4—4 of FIGS. 2 and 3 showing the undersurface grooves and central ridge construction of this invention.
Figure 5:
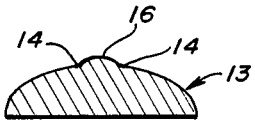
FIG. 5 is a cross-sectional view, as in FIG. 4, but taken at line 5—5 of FIGS. 2 and 3.

As shown in FIGS. 2 and 3, the improved neck 13 of this invention has a pair of parallel space-apart grooves 14 running the length of the neck from the peghead 15 all the way down the neck to the body, not shown. Ridge portion 16 of the neck undersurface is defined by such pair of grooves 14, the ridge tapering from the body end of the guitar to the peghead as shown in FIGS. 3, 4, and 5. Ridge 16 maintains normal thickness of the neck along its entire length, while the grooves 14 on either side thereof are drafted down in thickness and give the neck a thinner feel to the player, and in fact significantly reduce drag between the player's hand and the neck of the guitar, which in turn increases the speed of playing the instrument and lessens fatigue.

The grooves 14 defining ridge portion 16 of the neck undersurface begin at the body of the instrument and run up to or near the end of the peghead portion of the instrument. The grooves 14 are slightly further apart at the body or bottom of the neck than at the peghead end, due to the gradual reduction in size of a typical guitar neck, but as shown are substantially parallel to one another over the length of the neck. The grooves 14 are preferably located closer to the bottom of the neck than the fingerboard portion thereof, the precise location varying with the width of the ridge considered most advantageous. That is, if the grooves are too close together the ridge might feel too slight to the player's hand; whereas, if the grooves are too far apart, the neck will take on the feel of a conventional guitar neck.

The degree of tapering of the ridge portion, the width of the fingerboard and the thickness or depth of the neck, including the fingerboard, are all within the standard dimensions that any stringed musical instrument would have. The typical guitar, for example would have a width of about $1\frac{5}{8}$ inches at the peghead end and about $2\frac{1}{4}$ inches at the opposite or body portion end. The thickness of the conventional neck would vary from about $\frac{3}{4}$ inch at the first fret to 1 inch at the 12th fret.

The improved neck of this invention can be formed of wood, aluminum, metal alloys, synthetic composite fibers, and any other materials which can be used to construct stringed musical instruments. The novel neck construction has proven to be especially well-suited to the production of fiber-reinforced plastic guitars, such as electric guitars used by rock musicians.

It is claimed:

1. Improved neck for a stringed musical instrument having U-shaped neck and body and a fingerboard running the length of the instrument neck on the upper surface thereof, comprising:

substantially parallel grooves running the length of the undersurface of the neck, the grooves defining a rounded ridge portion on the neck undersurface, such ridge portion tapering in width and depth below the fingerboard from the body portion to the upper end of the instrument, such that a player's hand moving up and down the undersurface of the neck encounters less drag.

2. The improved neck of claim 1 wherein the materials of which the neck are formed comprise a fiber-reinforced plastic composite.

3. The improved neck of claim 1 wherein the grooves are located closer to the bottom of the neck than to the fingerboard portion thereof.

* * * * *